US008133138B1

(12) United States Patent
Hannah

(10) Patent No.: US 8,133,138 B1
(45) Date of Patent: Mar. 13, 2012

(54) ARCHERY BROADHEAD

(76) Inventor: Luke Hannah, La Plata, MD (US)

( * ) Notice: Subject to any disclaimer, the term of this patent is extended or adjusted under 35 U.S.C. 154(b) by 288 days.

(21) Appl. No.: 12/465,933

(22) Filed: May 14, 2009

(51) Int. Cl.
*F42B 6/08* (2006.01)

(52) U.S. Cl. ..... 473/583

(58) Field of Classification Search ..... 473/583, 473/584
See application file for complete search history.

(56) References Cited

U.S. PATENT DOCUMENTS

| | | | | |
|---|---|---|---|---|
| 3,036,395 | A * | 5/1962 | Nelson | 43/6 |
| 6,830,523 | B1 * | 12/2004 | Kuhn | 473/583 |
| 7,713,152 | B1 * | 5/2010 | Tentler et al. | 473/583 |
| 2010/0004078 | A1 * | 1/2010 | Flanagan | 473/583 |

* cited by examiner

*Primary Examiner* — John Ricci
(74) *Attorney, Agent, or Firm* — Steptoe & Johnson PLLC

(57) ABSTRACT

A broadhead is formed from a ferrule, at least one blade pivotally coupled to the ferrule, and a biasing member positioned under the blade between the ferrule. The biasing member applies pressure upward to a trailing edge of the blade, which is prevented from pivoting forward beyond a pre-determined angle in relation to the ferrule by a point coupled to the ferrule.

19 Claims, 4 Drawing Sheets

ARCHERY BROADHEAD

FIELD OF INVENTION

The invention relates generally to the field of archery, and more specifically to an archery broadhead with movable blades responsive to external forces.

BACKGROUND

Bowhunting arrow tips have been in use for years. Typically, bowhunting arrow tips are comprised of broadheads like the Vortex 100-125, Rocky Mountain Snyper, Sonoran 100-125, NAP Spiffire 100-125, Rockets Steelheads 100-125, Wasps Jackhammer 100-125, Game Tracker Silvertip 100, and Ironheads Expandables.

The main problem with conventional bowhunting arrow tips is the amount of penetration is insufficient to allow these broadheads to penetrate below-the-surface hard objects (such as hunted animal's ribs and shoulder blades). The resultant poor penetration creats a high probability for deflection, a high probability for catapulting and needlessly wounding game that cannot be recovered by the hunter. Another problem with bowhunting arrow tips designed to open on impact is the high level of deflection due to ineffectiveness of the blade actuation. Unless the shot is perpendicular to the target, this open, or cut-on-contact design flaw allows the broadhead's tip and/or blades to divert or steer the arrow off its course, wasting the kinetic energy that should be used for penetration. Another problem with conventional bowhunting arrow tips are in all other broadhead designs to date, very high levels of wedge exist when the blades are actuated to deploy. This occurs because whatever hole or cavity the tip created on impact is now too small for the rest of the body and/or blades to pass through without wedging. Even with perfect conditions and shot placement, the design flaws consume considerable amounts of the arrow's kinetic energy as frictional heat before some or any penetration occurs. This results in inhumane kills or permanent wounding of game that cannot be recovered by the hunter.

While these devices may be suitable for the particular purpose to which they address, they are not as suitable for providing a bow-hunting broadhead that has the ability to penetrate bone and soft tissue deeply and without wedging in the hole created by the tip.

In these respects, the anti-wedging broadhead according to the present invention substantially departs from the conventional concepts and designs of the prior art, and in so doing, provides an apparatus primarily developed for the purpose of providing a bow-hunting broadhead that has the ability to penetrate bone and soft tissue deeply and without wedging in the hole created by the tip while conserving the highest possible amount of kinetic energy.

SUMMARY OF INVENTION

The present invention relates to an archery broadhead that maintains a large broadhead surface area and cutting path while at the same time providing for maximum penetration. The broadhead functions by providing one or more retractable blades pivotally connected to a ferrule. A biasing member is positioned between the blade and ferrule. The biasing member applies pressure upward to a trailing edge of the blade, which is prevented from pivoting forward beyond a pre-determined angle in relation to the ferrule by a point coupled to the ferrule.

When penetrating a target, the blade will remain in its maximally extended position unless inward pressure greater than the outward pressure applied by the biasing member is applied to the leading edge of the blade. In such a situation, the blade pivots inwardly toward the ferrule until the broadhead passes through the source of the inward pressure at which time the blade will return to its maximally extended position because the upward pressure applied by the biasing member is greater than any inward pressure applied by an external force.

Other features and advantages will be explained in relation to the following embodiments of the invention.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
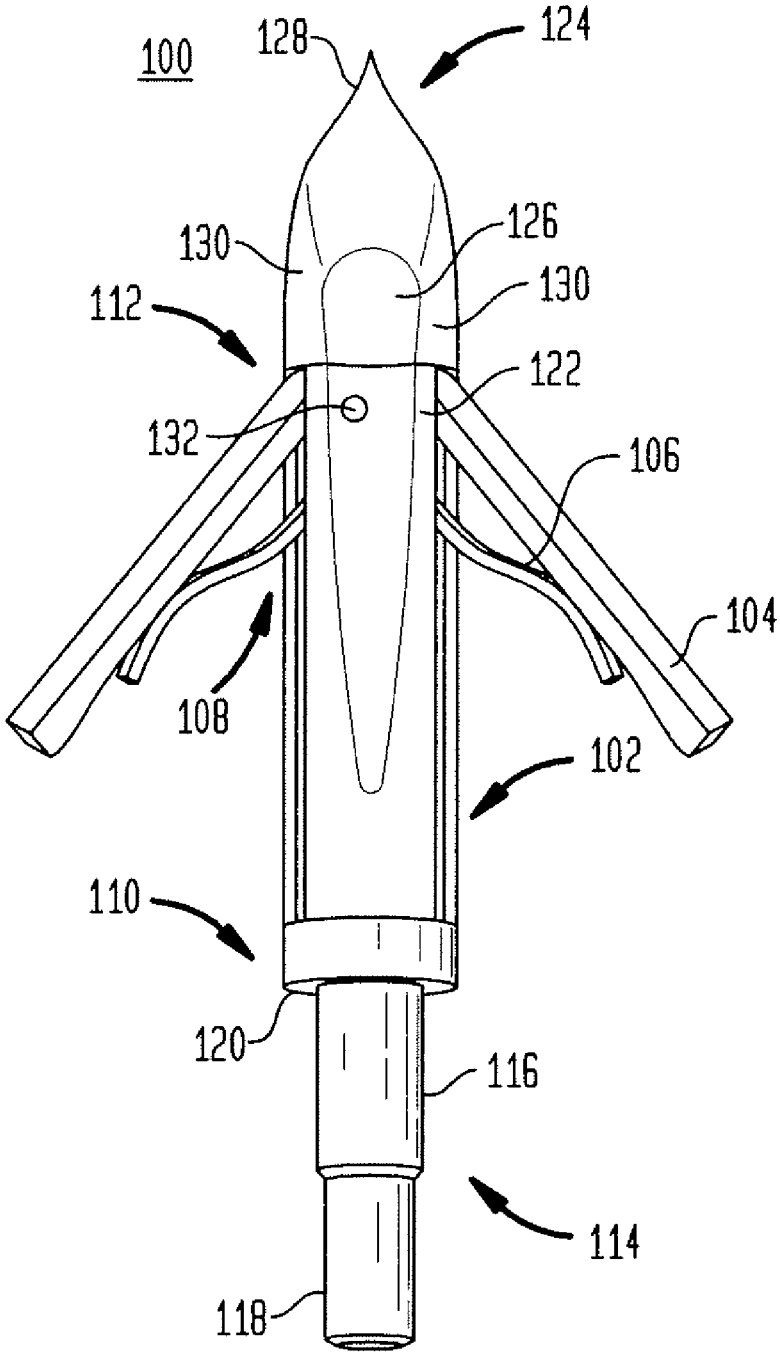
FIG. 1 is a perspective top view of one of many possible embodiments of a broadhead of the present invention.

FIG. 1 is a top view of an archery broadhead (broadhead) that includes a ferrule 102, at least one blade 104 pivotally connected to the ferrule 102, and a biasing member 106 positioned under the blade 104 between the ferrule 102 and the blade 104 such that the biasing member 106 applies upward pressure to the blade 104. The broadhead 100 also can include a point 124 detachably connected to the ferrule 102. A collar 120 can be included at the end of the broadhead opposite the point 124 for holding the biasing member 106 in place relative to the ferrule 102 and blade 104. A pin can be inserted through an aperture 132 in the ferrule 104 and positioned to receive the blade 104. The ferrule 102 has a middle blade mounting portion 108, a shaft engaging end 110 at one end of the blade mounting portion 108, and an opposed point end 112. The ferrule 102 can be fabricated from an aluminum alloy, carbon fiber composite material, stainless steel, or other materials such as alternative metals and plastics known to those skilled in the art.

The shaft engaging end 110 of the ferrule 102 can include an integral shaft mounting extension 114, which is comprised of an alignment shoulder 116 and a threaded insertion member 118 extending from the alignment shoulder 116. The shaft engaging end 110 of the ferrule 102 also can include a collar 120 against which the transverse face of the engaging end of an arrow shaft abuts when the broadhead 100 is secured to an arrow. The diameter of the ferrule 102 adjacent the collar 120 preferably is substantially equal to the diameter of the arrow shaft to prevent an abrupt change in diameter from the ferrule 102 to the arrow shaft that may tend to alter the aerodynamic balance of an arrow-broadhead combination during flight.

The collar 120 can be detachable and preferably is adapted to be journaled within a receiving bore contained within an arrow shaft at the engaging end of the arrow. The clearance between the outer peripheral surface of the collar 120 and the receiving bore provides precise alignment of the longitudinal axes of the broadhead 100 and the arrow shaft. The precise alignment of the broadhead 100 with the arrow shaft helps to maintain the aerodynamic balance of a complete arrow-broadhead assembly. The threaded insertion member 118 of the shaft mounting extension 114 is adapted to be received in a cooperating threaded aperture fainted within the arrow shaft. Those skilled in the art will appreciate that there are means other than the mounting extension 114 shown in the figures for engaging the broadhead 100 with an arrow shaft. For example, some broadheads may be provided with a cylindrical extension integral with the ferrule 102 which is adapted for receiving a glue-mounted to broadhead to a cooperating arrow shaft adapted for glue-mounted broadheads. Other broadheads may be provided with a female threaded cylindrical extension integral with the ferrule 102 which is adapted to engage a mating male threaded stud extending from the arrow shaft. Thus the integral shaft mounting extension 114 shown in the figures is provided for illustrative purposes and is not meant to limit the present invention to any specific means for mounting the broadhead 100 to an arrow.

The blade mounting portion 108 of the ferrule 102 comprises the majority of the length of the ferrule 102 and is the mounting site of the blades 104. The blade mounting portion 108 defines a generally circular cross section and includes a forward section 122 which has a uniform diameter. A point 124 comprising a generally cylindrical barrel 126 and a tri-faceted tip 128 can be secured detachably to the forward section 122 of the blade mounting portion 108. The point 124 can include a plurality of facet faces 130, and can have various configurations, such as a four faceted or conical point, or other configurations known to those skilled in the art. The facet faces 130 may be planar in configuration or may define a curved surface configuration having an axis of rotation that is perpendicular to the longitudinal axis of the ferrule 102.

The point 124 can include either a fixed or a detachable engaging member for connecting the point 124 with the ferrule 102. Alternatively, the point 124 can include a recessed receiving portion adapted for mating with the forward section 122 of the ferrule 102. The point 124 helps secure the blades 104 within the ferrule 102 by providing an adjacent surface beyond which the blades 104 cannot pivot forward. Preferably, the outside diameter of the cylindrical barrel 126 of the point 124 is substantially equal to the outside diameter of the forward section 122 of the ferrule 102. This provides a smooth transition between the point 124 and the ferrule 102 to insure desirable aerodynamics of the broadhead 100 at the transition point between the point 124 and ferrule 102.

Figure 2:
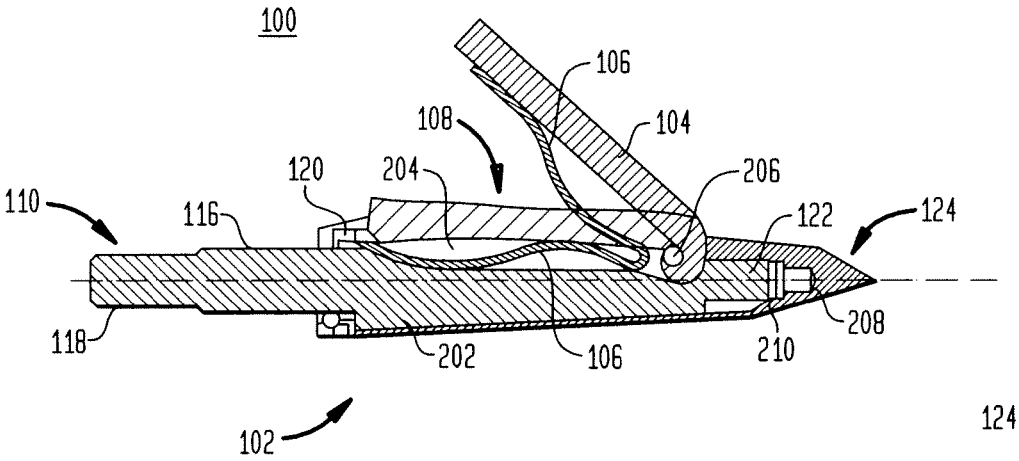
FIG. 2 is a planar side view of the broadhead.

FIG. 2 illustrates more clearly the shape of the ferrule 102, which can include a rearward flared section 202 defining a varying diameter such that the diameter of the ferrule 102 tapers from the rearward section 202 to the forward section 122, which has a diameter smaller than that of the flared section 202. The reduced diameter of the forward section 122 allows for the addition of a detachable point 124 to the ferrule 102 while the flared section 202 provides a gradual transition from the forward section 122 of the ferrule 102 to the arrow shaft. The forward section 122 of the blade mounting portion 108 also defines one or more longitudinally extending recessed portions 204 each adapted to receive a blade 104 and a biasing member 106. The recessed portion 204 begins at the rear face of the forward section 122 and extends rearward toward the rearward flared section 202. The recessed portion 204 has a length approximately equal to the length of the blade 104 and a depth sufficient to accommodate the biasing member 106 and to accept the blade 104 if and when the blade 104 is forced downward into the recessed portion 204. A forward facing section of the recessed portion 204 is adapted for receiving a mounting member 206 which extends transversely across the width of the recessed portion 204. The recessed portion 204 may be formed by conventional machining techniques known to those skilled in the art. A collar 120 can be placed around the flared section 202 not only to provide a surface against which an arrow shaft can be secured, but also to help maintaining the biasing member 106 within the recessed portion 204. More specifically, the collar 120 can go around a section of the biasing member 106 that is positioned longitudinally along the length of the recessed portion 202.

Figure 3:
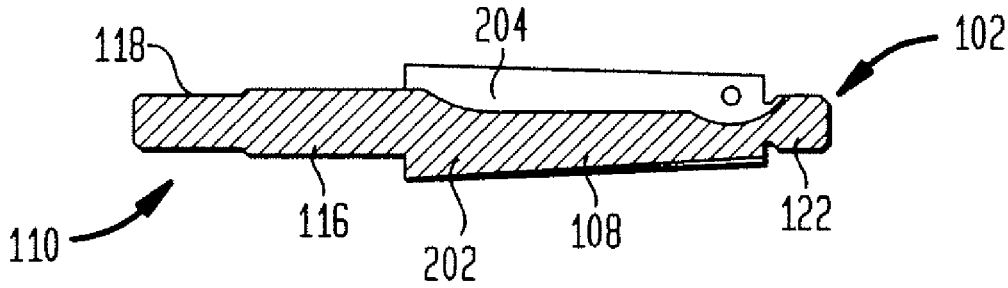
FIG. 3 is a planar side view of a ferrule.

FIG. 3 illustrates the recessed portion 204 within the ferrule 102. The ferrule 102 has a shaft engaging end 110 which includes an insertion member 118 and an alignment shoulder 116. The rearward flared section 202 of the ferrule 102 tapers and the diameter becomes smaller along the blade mounting portion 108 toward the forward section 122 of the ferrule 102. The recessed portion 204 is sufficiently long and deep to accommodate a biasing member and a blade when it is retracted due to external forces.

Figure 4:
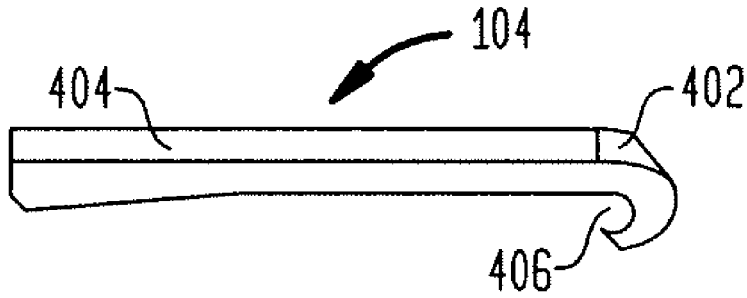
FIG. 4 is a perspective side view of a blade.

FIG. 4 illustrates the front portion of a blade 104 which includes a forward curved section 402 having an aperture 406. The aperture 406 is positioned around the mounting member to attached the blade 104 to the ferrule. A cutting region 404 of the blade 104 extends rearward from the curved section 402.

Figure 5:
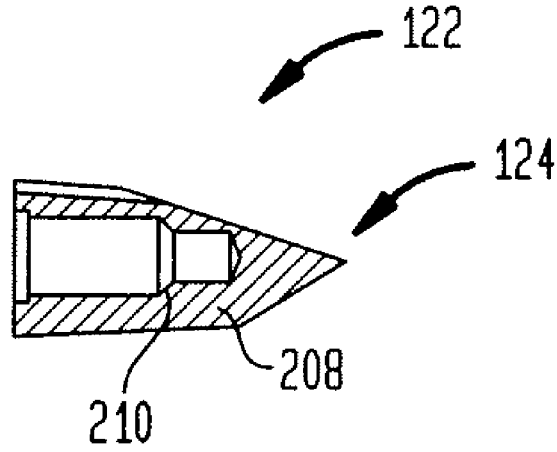
FIG. 5 is a planar side view of a point and ferrule.

FIG. 5 illustrates the relationship of the forward section 122 of the ferrule and the point 124. The ferrule can include a threaded tip end 208 which receives the point 124 by matching internal threads in the point 124 to threads 210 on the tip end 208 of the ferrule. The point 124 can be removed easily be screwing or unscrewing the point 124 onto or off of the threaded tip end 208.

While the invention has been described at some length and with some particularity with respect to the several described embodiments, it is not intended that it should be limited to any such particulars or embodiments or any particular embodiment, but it is to be construed with references to the appended claims so as to provide the broades possible interpretation of such claims in view of the prior art and, therefore, to effectively encompass the intended scope of the invention.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention. Thus, the breadth and scope of the invention should not be limited by any of the above-described exemplary embodiments.

What is claimed is:

1. A broadhead, comprising:

a ferrule;

at least one blade pivotally coupled to said ferrule; and a biasing member positioned under the blade between the ferrule and the blade such that the biasing member applies upward pressure to the blade; and a collar encircling the ferrule and holding a section of the biasing member in place relative to the ferrule and the blade.

2. The broadhead of claim 1, further comprising a connecting member positioned in the ferrule and adapted for receiving a forward end of the blade.

3. The broadhead of claim 2, wherein the blade further comprises a curved section having an aperture through which the connecting member is positioned and around which the blade pivots in response to external force applied to a leading edge of the blade.

4. The broadhead of claim 1, wherein the ferrule further comprises a blade mounting portion, a shaft engaging end at one end of the blade mounting portion, and an opposed point end.

5. The broadhead of claim 4, wherein the blade mounting portion of the ferrule comprises a recessed portion for receiving a section of the biasing member and a blade when the blade is retracted due to external forces applied to a leading edge of the blade.

6. The broadhead of claim 5, wherein the biasing member has a top section and a bottom section, and the bottom section is positioned in the recessed portion of the ferrule and the top section applies outward pressure away from the ferrule and against a trailing edge of the blade.

7. The broadhead of claim 5, wherein the blade pivots inwardly toward the ferrule into the recessed portion when external pressure applied to a leading edge of the blade is greater than the outward pressure applied by the top section of the biasing member against the trailing edge of the blade.

8. The broadhead of claim 1, wherein a trailing edge of the blade comprises a groove for receiving a top section of the biasing member.

9. The broadhead of claim 1, wherein the biasing member exerts about 200 psi to about 800 psi of upward pressure against a trailing edge of the blade.

10. The broadhead of claim 1, further comprising a point detachably connected to the ferrule.

11. A broadhead, comprising:

a ferrule;

at least one blade having a first end, a second end, a leading edge, and a trailing edge;

a biasing member positioned under the blade between the ferrule and the blade such that the biasing member applies upward pressure to the blade;

a point detachably connected to the ferrule; and a collar encircling the ferrule and holding a section of the biasing member in place relative to the ferrule and the blade.

12. The broadhead of claim 11, further comprising a connecting member positioned in the ferrule and adapted for receiving a forward end of the blade.

13. The broadhead of claim 12, wherein the blade has a curved front section with an aperture through which the connecting member is positioned and around which the blade rotates in response to external force applied to a leading edge of the blade.

14. The broadhead of claim 11, wherein the ferrule further comprises a middle blade mounting portion, a shaft engaging end at one end of the blade mounting portion, and an opposed point end.

15. The broadhead of claim 11, wherein a trailing edge of the blade comprises a groove for receiving a first elongated section of the biasing member.

16. The broadhead of claim 11, wherein the ferrule has an elongated recessed portion adapted for receiving an elongated section of the biasing member.

17. The broadhead of claim 16, wherein the recessed portion is adapted for receiving a section of the biasing member and a blade when the blade is retracted due to external forces applied to a leading edge of the blade.

18. The broadhead of claim 16, wherein the biasing member has a top section and a bottom section, and the bottom section is positioned in the recessed portion of the ferrule and the top section applies outward pressure against a trailing edge of the blade.

19. The broadhead of claim 16, wherein the blade pivots inwardly toward the ferrule into the recessed portion when external pressure applied to a leading edge of the blade is greater than the outward pressure applied by the top leg of the biasing member against the trailing edge of the blade.

* * * * *